US005872490A

United States Patent [19]

Kamimura

[11] Patent Number: 5,872,490

[45] Date of Patent: Feb. 16, 1999

[54] SIGNAL CABLE HAVING PARALLEL ARRANGED SHIELDED CONDUCTIVE LINES

[76] Inventor: Satoru Kamimura, 18, 1-chome, Sakura-machi, Iida-shi, Nagano, Japan

[21] Appl. No.: 784,727

[22] Filed: Jan. 16, 1997

Related U.S. Application Data

[63] Continuation of Ser. No. 445,743, May 22, 1995, abandoned.

[30] Foreign Application Priority Data

May 23, 1994 [JP] Japan ..... 6-132554

[51] Int. Cl.[6] ..... H01P 3/04

[52] U.S. Cl. ..... 333/4; 333/5; 333/236; 174/36

[58] Field of Search ..... 333/4, 5, 236, 333/243; 174/32, 34, 36

[56] References Cited

U.S. PATENT DOCUMENTS 2,684,993 7/1954 Bowers ..... 174/34 X
4,599,483 7/1986 Kühn et al. ..... 174/36

FOREIGN PATENT DOCUMENTS 1302612 12/1989 Japan .
3017330 3/1991 Japan .
6231625 8/1994 Japan ..... 174/36
1456999 2/1989 U.S.S.R. ..... 174/34

*Primary Examiner*—Benny Lee
*Attorney, Agent, or Firm*—Dorn, McEachran, Jambor & Keating

[57] ABSTRACT

A signal cable is provided with a first signal line and second signal line which are respectively connected between a first signal device and a second signal device and are constructed so as to transmit appointed signals, wherein the second signal line is a constant potential line and connects the first shielding line to the second signal line at the same potential at the first signal device side and simultaneously connects the second shielding line to the second signal line at the same potential at the second signal device side. Especially, there are two cases, one of which is a case where the first shielding line is conductively connected to the second signal line at the first signal device side, and simultaneously conductively connects the second shielding line to the second signal line at the second signal device side, and the other of which is a case where the second shielding line is conductively connected to the second signal line at the first signal device side, and simultaneously conductively connects the first shielding line to the second shielding line at the second signal device side.

6 Claims, 3 Drawing Sheets

SIGNAL CABLE HAVING PARALLEL ARRANGED SHIELDED CONDUCTIVE LINES

This as a continuation of application Ser. No. 08/445,743, filed May 22, 1995 and now abandoned.

BACKGROUND OF THE INVENTION

1. Field of the Invention

The present invention relates to a signal cable for transmitting electric signals, and in particular to a preferable technique when the signal cable is connected to an acoustic device or video device and is used as a high quality acoustic signal cable or video signal cable for increasing the transmission efficiency of acoustic signals or video signals.

2. Prior Arts

Conventionally, a two-strand coaxial cable equipped with a pair of signal lines and shielded by a shielding line provided at the circumference thereof via an insulating layer and a set of coaxial cable which shields a signal line with a shielding line via an insulating layer have been used as an acoustic cable or video cable making a connection between acoustic devices or video devices.

An acoustic cable or video cable is required to transmit signals in such states that the transmission signals are prevented from being attenuated and major frequency components of the signals to be transmitted are faithfully maintained, in order to increase the transmission efficiency of signals transmitted by the cable. Therefore, these kinds of signal cables are variously devised to decrease the attenuation and strain of a signal waveform and to eliminate influences due to external noise by improving the amplitude characteristics and phase characteristics of signals to be transmitted.

As one of these devices, for example, a balance type two-strand shield cable which is a set of coaxial cable consisting of a signal line and a shielding line to shield the signal line via an insulation layer is disclosed in Japanese patent publication No. Hei-3-17330, wherein the shield line connected for continuity to the inputting part of the signal line is prepared, and the set of cable is further shielded and formed by a common grounding shield.

Furthermore, another Japanese patent publication Hei-1-302612 discloses a cable in which a set of signal lines and shield line are connected to each other at the inputting side similarly to that in the above patent, the circumference thereof is shielded by another shield line, and these are further shielded by insulation resin.

These signal cables succeeded in decreasing the loss of transmission signals and influences of external noise to some degrees by further providing another shield line outside the shield line of the coaxial cable as shown above.

The above signal cables have been greatly improved with regard to both faithfulness of transmission signals and elimination of external noise, in comparison with prior conventional signal cables. However, it is necessary to shield signal lines by two conductor layers via three insulation layers, and furthermore as it is necessary to connect the respective two shield lines to the signal lines and an grounding end of a device in addition to the signal lines at the connection, the construction thereof is complicated to cause it to be very difficult to lower the production cost thereof.

Furthermore, there are some acoustic devices and video devices, which function improperly if a shield line of the signal cable is connected to the grounding line of the device. In a case where it is intended that the signal cable is connected to such devices, it is necessary to secure a separate protection circuit between the grounding line of the device and internal circuits. Still furthermore, some devices do not have any grounding line to which the shield line of signal cable is connected. In a case where the above signal cable is connected to such devices, it is necessary to provide grounding in addition to the device.

SUMMARY OF THE INVENTION

The present invention relates to a signal cable comprising a first signal line and a second signal line respectively connected between a first signal device and a second signal device and constructed so that they transmit signals of different potential, a first shield line for shielding the first signal line via an insulation body and a second shielding line for shielding the second signal line via an insulation body, wherein the second signal line is a constant potential line, the first shield line is connected to the second signal line at the same potential at the first signal device side, and the second shield line is connected to the second signal line at the same potential at the second signal device side.

It is therefore an object of the invention to provide a signal cable which can transmit as much information of signals received from a signal source as possible without diminishing. The transmission characteristics are improved by lowering the ratio of attenuation with the amplitude of transmission signals maintained, lowering the phase changes (frequency characteristics) with the phase characteristics of transmission signal maintained, and diminishing influences upon the signal line created by external noise as much as possible.

It is another object of the invention to provide a technique with which the transmission characteristics of transmission signals can be easily improved by only changing a shielding line connection method in a usual coaxial signal cable shielded by a shield line via an insulation layer.

It is a still further object of the invention to provide a signal cable which can be very simply mounted, by not requiring any connection of grounding line for various electric devices.

BRIEF DESCRIPTION OF THE DRAWINGS

These and other objects and features of the invention will be made clear in the following detailed description with reference to the drawings attached herewith.

DETAILED DESCRIPTION OF PREFERRED EMBODIMENTS

[First preferred embodiment]

Figure 1:
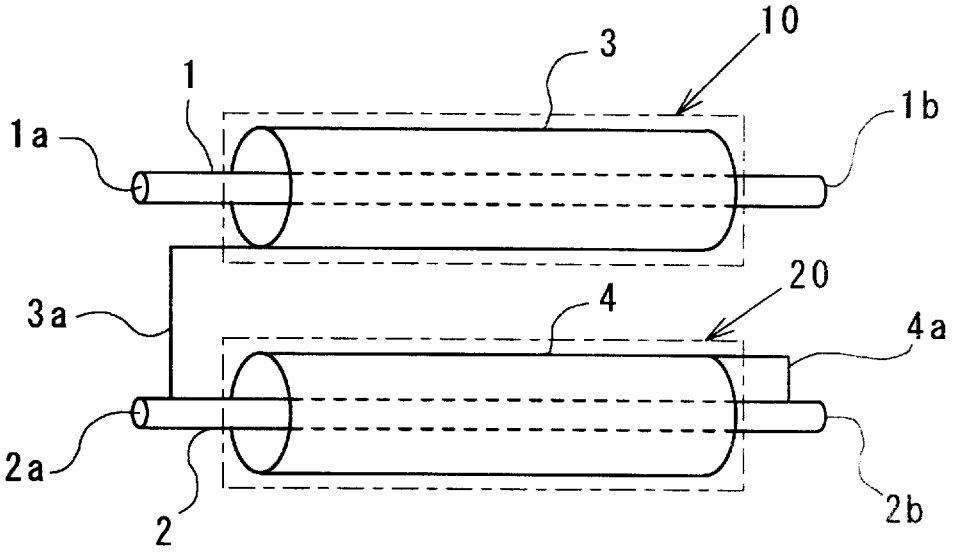
FIG. 1 is a view explaining the concept of construction of a first preferred embodiment according to the invention.

FIG. 1 shows the structure of the first preferred embodiment according to the invention. The preferred embodiment is an acoustic cable or video cable which is connected between a transmission device, for example, preamplifier, and a receiving device, for example, a power amplifier. Signal lines 1, 2 are mounted so that they connect between the transmission device and receiving device. These signal lines 1, 2 are provided so as to connect a transmission device to a receiving device. These signal lines 1, 2 are, for example, such that an oxygen-free copper line is plated with silver or gold as occasion demands or a plurality of pure silver lines are bundled or twisted.

A shielding line 3 is provided at the signal line 1 via an insulating layer (not illustrated), and a shielding line 4 is provided at the signal line 2 via an insulating layer (not illustrated). The shielding lines 3,4 are braided in which a copper wire is cylindrically formed on the surface of an artificial resin made insulation shield formed on the circumference of the signal lines 1, 2. These shielding lines 3, 4 may be formed with a thin conductive cylinder (for example, cylinder formed with copper film). It is preferable that the insulating layer is formed of an artificial resin such as tetrafloroethylene fluorocarbon polymers (for example, Junflon (Brand name of Junkosha, Ltd.)).

Figure 2:
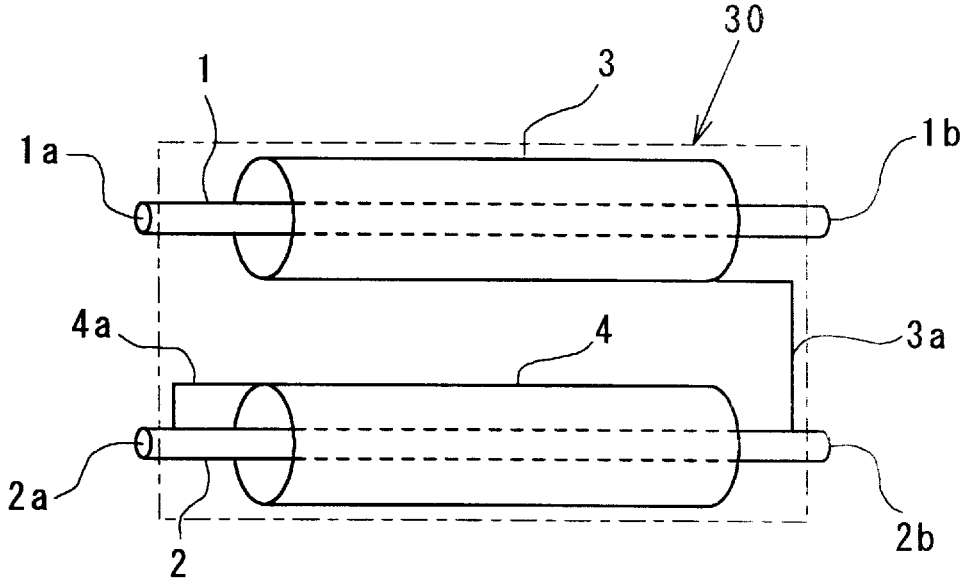
FIG. 2 is a view explaining the concept showing a modification of the first preferred embodiment.

Furthermore, a signal line 1 and a shielding line 3 to shield the signal line 1, and a signal line 2 and a shielding line 4 to shield the signal line 2 may be formed to be a pair of cables 10, 20 as shown in FIG. 1, by shielding the respective groups with an insulating shield, or both the shielding lines 3, 4 may be buried in an integral insulating shield in a spaced state and may be formed to be one cable 30 as shown in FIG. 2.

The input end 1*a* of the signal line 1 and the input end 2*a* of the signal line 2 are connected to a transmission device, and the output end 1*b* of the signal line 1 and the outer end 2*b* of the signal line 2 are connected to a receiving device. Here, acoustic signals and video signals are provided between the signals 1 and 2, and the signal line 2 thereof is connected to the grounding line of the transmission device and receiving device.

The shielding line 3 is provided with a connection line 3*a* led from the input end 1*a* side, and the connection line 3*a* is conductively connected to the vicinity of the input end 2*a* of the signal line 2. Furthermore, the shielding line 4 is provided with a connection line 4*a* led from the output end 2*b* side of the signal line 2, and the connection line 4*a* is conductively connected to the vicinity of the output end 2*b* of the signal line 2.

In the preferred embodiment, both the shielding lines 3, 4 are connected to the signal line 2 and is indirectly grounded. Therefore, as in conventional types, the shielding lines 3, 4 function as an electromagnetic shield against external noise, etc, and diminish the influences due to external noise, etc. At the same time, as the shielding lines 3, 4 are mutually connected to the end portion at the opposite side of the signal line 2, the signal transmission characteristics are improved, and especially, as the phase characteristics of transmitting signals are improved, the tone quality of acoustic signals and image quality of video signals are remarkably improved.

For example, in comparison with a case where a conventional multi-strand cable is used for similar transmission and receiving devices, sounds of some musical instruments of orchestra, which can not be heard clearly or at all, will be able to be clearly heard by using a signal cable according to the preferred embodiment of the invention. It is very difficult to measure the transmission characteristics of a cable for actual acoustic signals or video signals because the measurement greatly depends on the measuring instruments, arranging state of the cable, etc. However, according to the result of hearing experiments for various kinds of acoustic signals, which have been carried out by the inventor et al for a plurality of listeners, in a case where a comparatively high quality acoustic device is used, a clear difference has been obtained between the preferred embodiment and conventional devices regardless of places used or listeners.

The effects of a signal cable according to the invention are clearly increased in cases where the signal cable is used in an acoustic signal reproduction device such as a CD (Compact Disc) player which can output high quality acoustic signals, a signal amplification device such as a high quality preamplifier, power amplifier, etc or a signal conversion device such as a high quality speaker, etc.

With a conventional coaxial cable, the amplitude characteristics and phase characteristics for frequency components of signals fluctuate to cause the waveform of the transmitting signals to be attenuated at the output side, and at the same time good signals are not obtained at a receiving device. But with the preferred embodiment, the signal S/N ratio is totally improved, and at the same time, in a case where the signal cable is used as an acoustic cable, a sense of lifelike sound mix which is clearly distinguishable is obtainable.

The reason why the transmission characteristics are improved is not clear. However, as the shielding lines 3 and 4 are conductively connected at the end portion of the opposite side of the signal line 2, respectively, the potential fluctuation induced to the shielding line 3 by signals which are transmitted to the signal line 1 will hardly influence the potential of the shielding line 4 in comparison with a case where, for example, both the shielding lines are connected to the same side of the signal line 2 to cause the potential fluctuation of the signal line 2 to be diminished or the time constant of the potential fluctuation to be made shorter. Therefore, it is considered that the stability of signal transmission and receiving is improved.

On the other hand, in the arts disclosed in the above Japanese patent publication Nos. Hei-3-17330 and Hei-1-302612, as the shielding line for enclosing the circumference of the signal line is conductively connected to the signal line itself at the input end, the signal line and shielding line are set to the same potential, thereby causing the influence of the surrounding for signal lines 1, 2 to be lowered, and the transmission loss to be diminished. However, in this case, as the shielding line is maintained at the same potential as that of the signal line, it is necessary to provide an grounding shield against external noise at the circumference thereof. In the preferred embodiment, as the shielding line 3 is connected to the signal line 2, the signal line 1 and shielding line 3 are not at the same potential.

It is clear that the preferred embodiment shows better signal transmission characteristics than any conventional signal cable. However, although various reasons why the difference occurs between them are assumed, no clear factor is proven at this moment. However, in any case, it is clear from the experiments carried out by the inventor that the effects of the preferred embodiment results from the above structural differences.

Differing from the conventional arts shown in the literatures cited above, the preferred embodiment has an advantage with which a signal cable can be produced at a lower cost than conventional ones as it is not necessary to provide a double shielding line. This is because in the conventional arts in addition to the necessity of providing a second shielding line (outer shielding line to enclose the shielding line), it is also necessary to the second shielding line to connect the grounding potential.

Next, another variation of the first preferred embodiment is described below. As shown in FIG. 2, in the construction similar to the above preferred embodiment, a connection line 3*a* led from the shielding line 3 is connected to the signal line 2 at the output end 1*b* side of the signal line 1. Furthermore, a connection line 4*a* led from the shielding line 4 is connected to the signal line 2 at the input end thereof. In a case where the connection lines are thus connected, the degree of improving the transmission characteristics of signals may be made lower in a sense, but the performance difference thereof is clear in comparison with the conventional cables.

[A second preferred embodiment]

Next, a second preferred embodiment of a signal cable according to the invention will be described with reference to FIG. 3 and FIG. 4. In this preferred embodiment, the structure of signal lines 1, 2 and shielding lines 3, 4 is similar to that of the first preferred embodiment, and the same parts are given the same reference numbers. The explanation thereof is therefore omitted. In this preferred embodiment, a connection line 3*a* led from the shielding line 3 is connected to the vicinity of the input end 2*a* of the signal line 2 at the input end 1*a* side of the signal line 1. Furthermore, the shielding line 3 and shielding line 4 are conductively connected to each other at the output ends 1*b*, 2*b* of the signal lines 1, 2.

Figure 3:
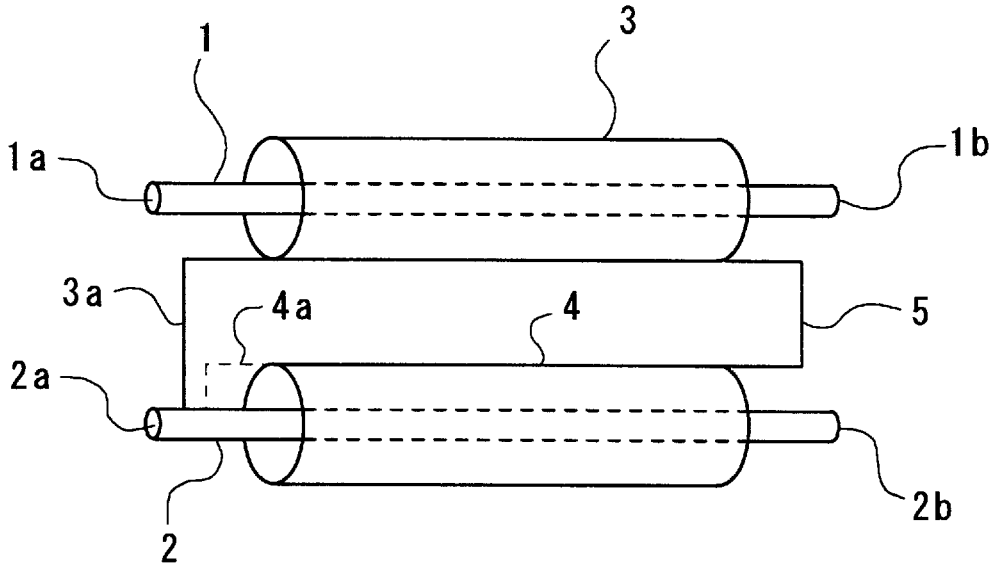
FIG. 3 is a view explaining the concept of construction of a second preferred embodiment according to the invention.
Figure 4:
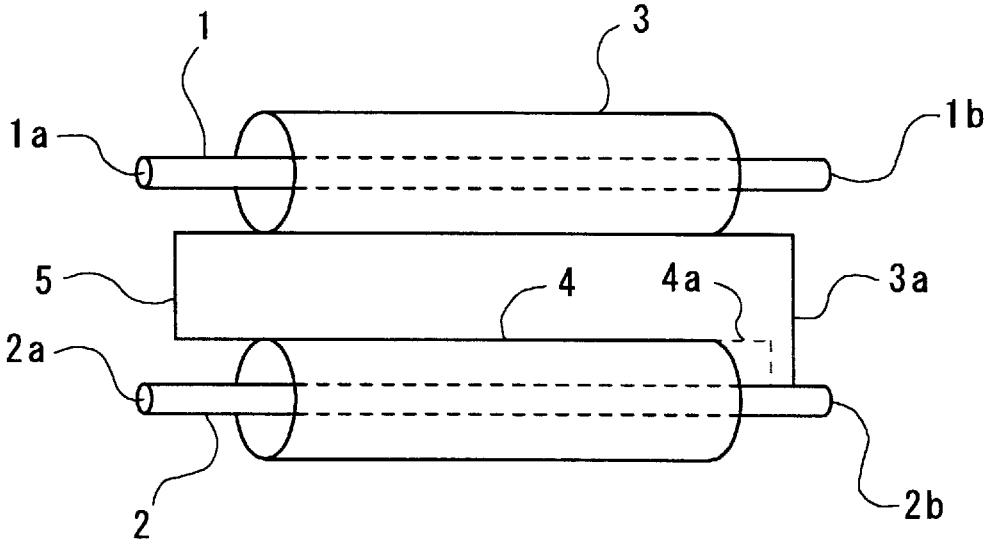
FIG. 4 is a view explaining the concept showing a modification of the second preferred embodiment.

In the second preferred embodiment, a variation shown in FIG. 4 is available. In the variation example, a connection line 3*a* led from the shielding line 3 at the output end 1*b* side of the signal line 1 is connected to the vicinity of the output end 2*b* of the signal line 2, and the shielding line 3 and shielding line 4 are conductively connected to each other at the input ends 1*a*, 2*a* sides of the signal lines 1, 2. In this case, as still another variation, a connection 4*a* may be used for connection instead of the connection line 3*a*, as shown with dashed lines in FIG. 3 and FIG. 4.

In the second preferred embodiment, the shielding line 3 is directly conductively connected to the signal line 2, and at the same time, the shielding line 4 is conductively connected to the signal line 2 via a connection line 5 and shielding line 3. In these preferred embodiments, the position where the shielding line 3 and shielding line 4 are conductively connected to each other via the connection line 5 and the position where the shielding line 3 or shielding line 4 is conductively connected to the signal line 2 by the connection lines 3*a*, 4*a* are mutually reversed. That is, it is featured that, in a case where the connection line 5 is connected at the output end side, the connection lines 3*a*, 4*a* are connected at the input end side.

If the point of this feature is lost, for example, even in a case where the connection line 5, which conductively connects the shielding line 3 and shielding line 4 to each other, and the signal line 2 are connected at the side where the connection line 5 is connected, the shielding lines 3 and 4 will be conductively connected to the signal line 2 as in the second preferred embodiment. However, no effect of the invention will be secured. Therefore, it is understood that the about feature point is a substantial structure of the invention.

When the second preferred embodiment shown in FIG. 3 and FIG. 4 was actually mounted in an acoustic device and was used for experiments, it was made clear that the second preferred embodiment was more effective than the first preferred embodiment shown in FIG. 1 and FIG. 2. Generally, it is said that grounding a shielding line at the output side of the signal line is more advantageous from the viewpoint of the countermeasure against noise, and it is considered that an embodiment shown in FIG. 4 is most preferable at this moment.

The second preferred embodiment is suitable in a case where effective grounding is not possible at either the transmission device or receiving device, for example, where no protection circuit is provided for an grounding line of a device. In this case, a connection line 3*a* is connected to the device which can be grounded. It is preferable from the viewpoint of the countermeasure against noise that a connection line 5 is accommodated inside the insulation shield just before the terminal at the cable end without connecting the connection line 5 to the terminal at the cable end, and both the shielding lines are connected.

In this preferred embodiment, although the shielding line 3 and shielding 4 are connected to each other by a connection line 5, the potential fluctuation of the shielding line 3 induced by signals of the signal line 1 inversely operates on the signal line 2. Therefore, it is considered that there is a possibility that a connecting pattern of both the shielding lines like this may spoil an action of the stray capacity (depending upon the distance between the lines) between the shielding line 3 and shielding line 4.

[A third preferred embodiment]

Figure 5:
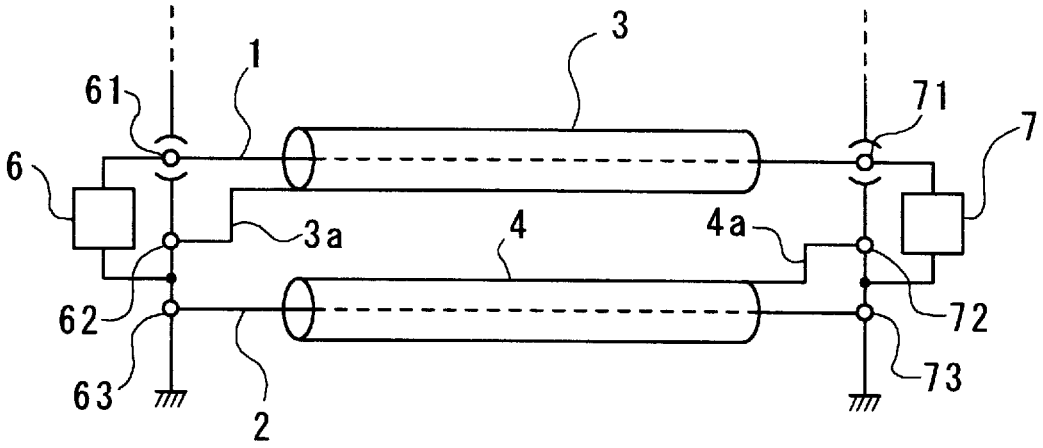
FIG. 5 is a view explaining the concept of construction of a third preferred embodiment according to the invention.
Figure 6:
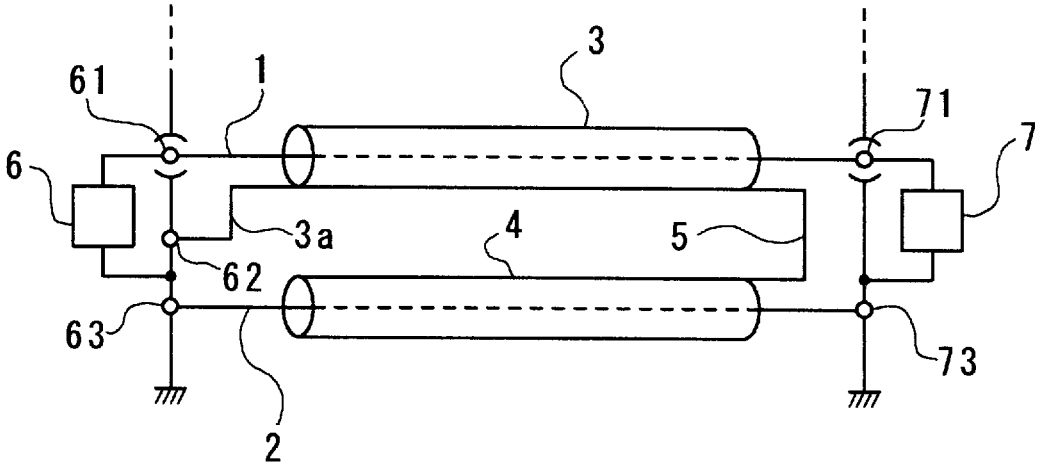
FIG. 6 is a view explaining the concept showing a modification of the third preferred embodiment.

A third preferred embodiment according to the invention is shown in FIG. 5 and FIG. 6. This preferred embodiment shows an example of a signal cable to be connected between a preamplifier and a power amplifier in an acoustic device. As shown in FIG. 5, a shielding line 3 is disposed on the circumference of a signal line 1, and a shielding line 4 is disposed on the circumference of a signal line 2. The input end of the signal line 1 is connected to the output terminal 61 of a preamplifier 6, and the input end of the signal line 2 is connected to the output terminal 63 of the preamplifier 6. The output terminal 63 of the preamplifier is at the same potential as that of the grounding line, and an grounding terminal 62 is provided in addition thereto.

The signal line 1 is connected to the input terminal 71 of the power amplifier 7, and the signal line 2 is connected to the input terminal 73 of the power amplifier 7. The input terminal 73 is at the same potential as that of the grounding line, and an grounding line 72 is provided in addition thereto. A connection line 3*a* is led from the input side of the shielding line 3 and is connected to the grounding line 62 of the preamplifier 6. A connection line 4*a* is led from the output side of the shielding line 4 and is connected to the grounding terminal 72 of the power amplifier 7. FIG. 6 shows a variation model of the above preferred embodiment, wherein instead of the connection line 4*a*, a connection line 5 is provided, which conductively connects the shielding line 3 and shielding line 4.

In the above preferred embodiment shown in FIG. 5, although being indirect, the shielding lines 3, 4 are connected to the signal line 2, and the preferred embodiment is constructed as in the first preferred embodiment and brings similar effects. A variation model shown in FIG. 6 is constructed similarly to the second preferred embodiment shown in FIG. 3 and brings similar effects. The reference numerals appearing in FIG. 6 correspond to the identically labeled reference numerals described with respect to FIG. 5. Here, a cable which is connected between the preamplifier 6 and power amplifier is shown as an example. However, it may be connected in a similar manner between an acoustic player or video player and a preamplifier and between an amplifier and a speaker or a monitor.

The invention has a feature point which is a structure common to the above three preferred embodiments, wherein connection lines are lead from the vicinity of the ends at mutually opposite sides of two shielding lines which respectively shield two signal lines. With this feature point, it is possible to diminish attenuation of signals to be transmitted, strain and/or influences thereof due to external noise and to carry out high quality signal transmission. Especially, in cases where a signal cable according to the invention is adopted in a high quality audio device, a remarkable difference in the tone quality will be obtained.

What is claimed is:

1. A signal cable having first and second signal lines connected in parallel at respective ends thereof to corresponding first and second signal devices, said second signal line arranged to carry a signal of constant potential, a second shielding line conductively connected to said second signal line at said first signal device end and first shielding line conductively connected to said second shielding line at said second signal device end.

2. The signal cable of claim 1 in which said first and second signal lines and said first and second shielding lines are encapsulated in a common insulating body.

3. A signal cable having first and second signal lines connected in parallel at respective ends thereof to corresponding first and second signal devices, said second signal line arranged to carry a signal of constant potential, a first shielding line conductively connected to said second signal line at said first signal device end and said first shielding line conductively connected to a second shielding line at said second signal device end.

4. The signal cable of claim 3 in which said first and second signal lines and said first and second shielding lines are encapsulated in a common insulating body.

5. A signal cable having first and second signal lines connected in parallel at respective ends thereof to corresponding first and second signal devices, said second signal line arranged to carry a signal of constant potential, a first shielding line conductively connected to said second signal line at said first signal device end and a second shielding line connected to said second signal line at said second signal device end.

6. The signal cable of claim 5 in which said first and second signal lines and said first and second shielding lines are encapsulated in a common insulating body.

* * * * *